United States Patent [19]

Shady

[11] 4,263,985

[45] Apr. 28, 1981

[54] MOVABLE SCAFFOLD SUPPORT

[76] Inventor: Clarence D. Shady, 4208 Foellinger Dr., Fort Wayne, Ind. 46818

[21] Appl. No.: 8,608

[22] Filed: Feb. 1, 1979

[51] Int. Cl.[3] ..... E04G 3/10

[52] U.S. Cl. ..... 182/119; 182/127; 182/150

[58] Field of Search ..... 182/118, 150, 36, 38, 182/37, 127, 119

[56] References Cited

U.S. PATENT DOCUMENTS

| | | | |
|---|---|---|---|
| 3,391,757 | 7/1968 | Duke | 182/38 |
| 3,854,550 | 12/1974 | Shingler | 182/118 |
| 3,900,080 | 8/1975 | Rea | 182/36 |

FOREIGN PATENT DOCUMENTS

| | | | |
|---|---|---|---|
| 2283280 | 3/1976 | France | 182/36 |
| 1019275 | 2/1966 | United Kingdom | 182/36 |

*Primary Examiner*—Reinaldo P. Machado
*Attorney, Agent, or Firm*—David A. Lundy

[57] ABSTRACT

A movable roof-supported scaffold support which comprises front and rear vertical frame members which are detachably connected by a plurality of spaced-apart connectors. At least three spaced-apart pairs of wheels are mounted on the support. One wheel of each pair is adjacent to the front frame member; the other wheel being remote therefrom. A scaffold connector assembly is secured to the front vertical frame member.

9 Claims, 4 Drawing Figures

MOVABLE SCAFFOLD SUPPORT

BACKGROUND OF THE INVENTION

The invention relates to scaffolds and scaffold supports, and in particular to a movable roof-supported scaffold support.

Roof supported scaffold supports have been used in the past. Some are stationary, and some are movable. Scaffolds are connected to the supports so as to depend from the supports and overlay a wall of a building. Each must support securely the scaffold and the men and equipment working on the scaffold. Some scaffold supports are capable of supporting a scaffold extending only a single story of a building. Other scaffold supports are capable of supporting scaffolds extending a number of stories. Each of these scaffold supports must be movable from time to time and must be easily transportable from building to building. Thus, it would be highly desirable to provide the improved scaffold support which would support scaffolds of both a single story and multi-stories and which could be "dismantled" and "set up" relatively easily.

Movable roof-supported scaffold supports allow the scaffold and scaffold support to be moved from one position along an exterior building wall to another position.

However, movable roof-supported scaffold supports of the past have experienced problems with regard to successfully turning the corners of a building. The result of which is that the scaffold must be taken down and reassembled on each wall of the building. Thus, it would be highly desirable to provide a movable roof-supported scaffold support having all of the features of prior movable scaffold supports and the ability to turn the corners of a building.

SUMMARY OF THE INVENTION

It is an object of the invention to provide an improved roof-supported scaffold support.

It is another object of the invention to provide an improved movable, roof-supported scaffold support.

It is another object of the invention to provide an improved movable, roof-supported scaffold support which has the ability to easily and successfully turn the corners of the building.

It is another object of the invention to provide an improved movable, roof-supported scaffold support which has the ability to support a scaffold assembly ranging from a simple story to many stories in length.

It is another object of the invention to provide an improved movable, roof-supported scaffold support which when once "set up" so as to support a scaffold depending therefrom and overlaying an exterior wall of a building, can be moved from position to position around the periphery of a building, easily and without having to dismantle the scaffold and scaffold support.

Finally, it is another object of the invention to provide an improved movable, roof-supported scaffold support having the ability to be dismantled into a number of easily manageable pieces so that the support can be readily transported to and from building sites.

The invention in its broadest aspects is a movable roof-supported scaffold support comprising front and rear vertical frame members which are detachably connected together by a plurality of spaced-apart connectors. At least three spaced-apart pairs of wheels on the support. One wheel of each pair is adjacent to the front frame member; the other wheel being remote therefrom. A scaffold connector assembly is secured to the front vertical frame member.

BRIEF DESCRIPTION OF THE DRAWINGS

The above mentioned and other features and objects of this invention and the manner of attaining them will become more apparent and the invention itself will be best understood by reference to the following description of the invention taken in conjunction with the accompanying drawings wherein.

DETAILED DESCRIPTION OF A SPECIFIC EMBODIMENT

Figure 1:
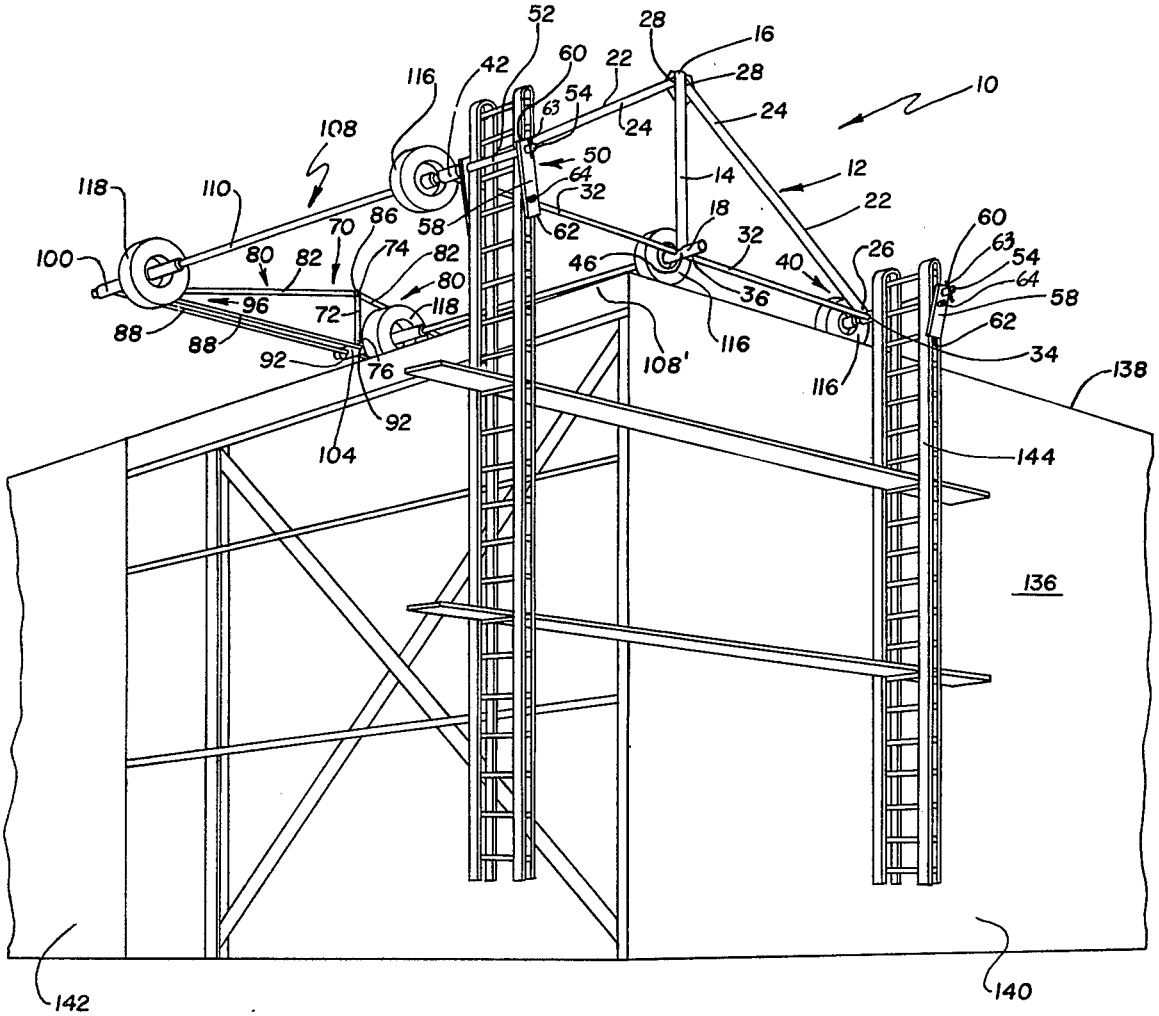
FIG. 1 is a perspective view of the movable scaffold support of the invention as being used in conjunction with a building structure.
Figure 3:
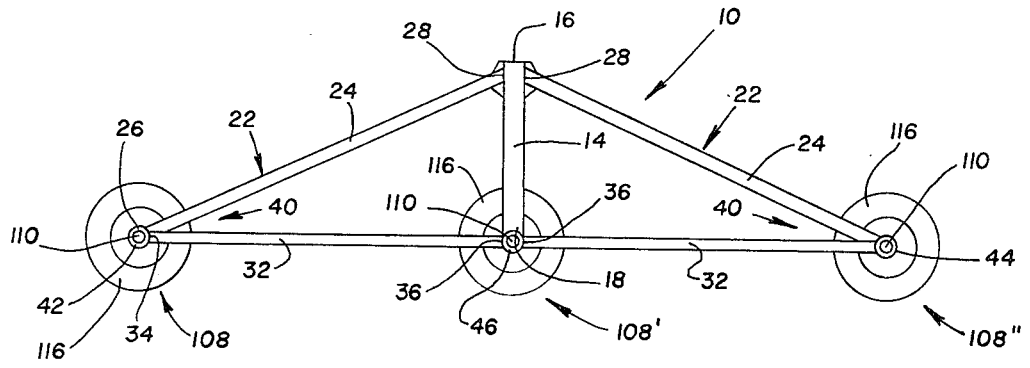
FIG. 3 is a rear plan view of the movable scaffold support of the invention.
Figure 2:
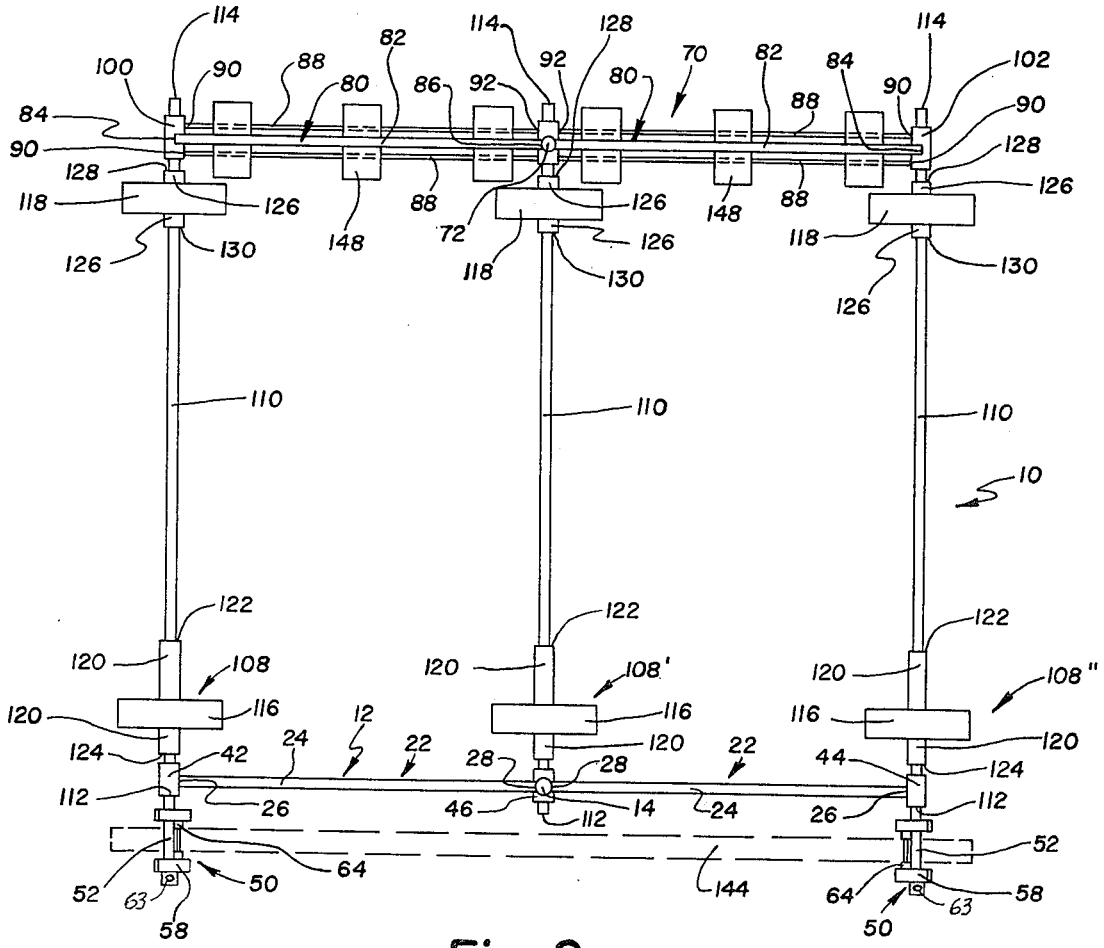
FIG. 2 is a top plan view of the movable roof-supported scaffold support of the invention.
Figure 4:
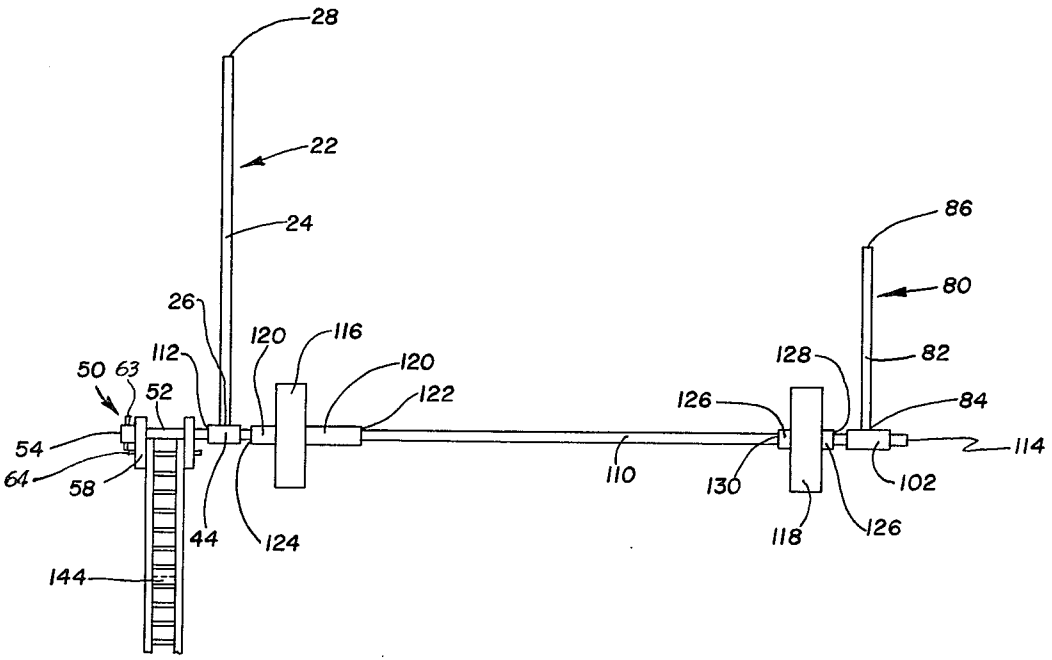
FIG. 4 is side plan view of the movable scaffold support of the invention.

The movable scaffold support 10 of the invention includes a front vertical frame member 12. The front vertical frame member 12 include a vertical post or altitudinal member 14 having top 16 and bottom 18 ends. A pair of braces 22 each having an angularly disposed or congruent side member 24 having opposite ends 26, 28, and a horizontally disposed base member 32 having opposite ends 34, 36. The angularly disposed side members 24 and horizontally disposed base members 32 are secured together at the one ends 26 and 34 thereof, respectively. The angularly disposed side members 24 and horizontally disposed base members 32 are secured at the other ends 28 and 36 thereof, respectively, to the top 16 and bottom 18 ends of the vertical post 14. A vertex 40 is formed at the intersection of the angularly disposed 24 and horizontally disposed 32 members thereby generally forming an isosceles triangle or frame member 12.

The front vertical frame member 12 further includes a trio of first 42, second 44 and third 46 cylindrical connectors. The first connector 42 is secured at the vertex 40 of the one member of the pair of braces 22. The second connector 44 is secured at the vertex 40 of the other member of the pair of braces 22. The third connector 46 is secured to the bottom end 18 of the vertical post 14 in such a manner that the horizontally disposed member 32 of each brace 22 is secured thereto.

The movable scaffold support 10 of the invention further includes a rear vertical frame member 70. The rear vertical frame member 70 includes a vertical post or altitudinal member 72 having top 74 and bottom 76 ends. A pair of braces 80 wherein each brace 80 includes an angularly disposed or congruent side member 82 having opposite ends 84, 86, and a pair of parallel, spaced-apart, horizontally disposed base members 88 having opposite ends 90, 92. The angularly disposed member 82 and the paired horizontally disposed member 88 are secured together at one ends 84 and 90, thereof, respectively. The angularly disposed member 82 is secured at the other end 86 thereof to the top end 74 of the vertical post 72, and the paired horizontally disposed members 88 are secured at the other end 92 thereof to the bottom end 76 of the vertical post 72. The angularly disposed member 82 and the paired horizontally disposed members 88 intersect to form a vertex 96, thereby to form an isosceles triangular frame member 70.

The rear vertical frame member 70 further includes a trio of first 100, second 102 and third 104 cylindrical connectors. The first 100 and second 102 connectors are secured adjacent the vertex 96 of each brace 80 of the paired braces 80, respectively. The third connector 104 is secured to the bottom end 76 of the vertical post 72 in such a fashion that the paired horizontally disposed members 88 are also secured at the other ends 92 thereof to the third connector 104.

The movable scaffold support 10 of the invention further includes a trio of wheel assemblies 108, 108', 108''. Each such wheel assembly 108 includes a rod or axle 110 having opposite ends 112, 114 and a pair of wheels 116, 118. One wheel 116 of the pair is mounted on integral sleeve 120 having opposite ends 122, 124. When journalled on the axle 110, the one sleeve end 122 extends a greater distance rearwardly of the one wheel 116 than does the other sleeve end 124 extend forwardly of the one wheel 116. The other wheel 118 of the pair also is mounted on an integral sleeve 126 having opposite ends 128, 130. When journalled on the axle 110, the sleeve ends 128, 130 extend equal distances from either side of the other wheel 118. The greater extension of the one sleeve end 122 allows the load of the scaffold 144 to be more evenly spread over the length of the axle 110. The applicant has found that because the maximum load is located at the one (front) wheel 116, the one end 122 of the sleeve 120 must have this greater extension to restrain the bending movement in and to prevent bowing of the axle 110.

A scaffold holder assembly 50 includes a pair of arms 58, each having opposite ends 60 and 62 connected to the end portion 52 of the axle 110 and depending therefrom. The arms 58 are retained on the axle 110 by a bolt 63 passing through the axle 110. A bolt 64 extends through both arms 58 and through the rungs of the ladder of the scaffold 144 at the distal end 62 of arms 58.

Further illustrated is a building 136 upon the roof 138 of which rests the movable scaffold support 10. A scaffold 144 is connected to the scaffold holder assembly 50. A plurality of sand bags or ballast 148 is draped over the pair of horizontally disposed members 88.

As previously mentioned, the movable scaffold support 10 of the invention is detachable into the basic components of the front 12 and rear 70 vertical frame members, the three axles 110, and the three pairs of wheels 116, 118, so that the movable scaffold support 10 is easily transported to building sites by conventional means. Once at the building site, the basic components are positioned on the roof 138 of the building 136 and are assembled thereon by mounting the paired wheels 116, 118 onto the axles 110 and then connecting the front 12 and rear 70 vertical frame members together in a parallel, spaced-apart fashion by placing the axles 110 in the connectors or journals 42, 44, 46, 100, 102, and 104.

In a specific embodiment, rods 110, sleeves 120 and 126, frame members 14, 24, 32, 72, 82 and 88, and connectors 42, 44, 46, 100, 102, and 104 are lengths of conventional pipe.

In operation, the scaffold support 10 is erected and the front vertical member 12 is brought near the edge of the roof 138 of the building 136 where the work involving the scaffold 144 needs to be performed. The scaffold 144 is connected to the movable scaffold support 10.

When properly used, the wheel sleeves 120 and 126, the paired horizontal members 88 of the rear vertical frame member 70 and sand bags 148 draped over the paired horizontal members 88 provide a counter weight to the weight of the scaffold 144 connected to the movable scaffold support 10 and any workmen and equipment standing on the scaffold 144. The fact that a selected number of sand bags or ballast 148 may be draped over the paired horizontal members 88 provides a flexibility that allows the balancing of scaffolds ranging from one story to many stories high under various operating conditions.

With regard to the work performed along the length of the building wall 140, as the workmen need to move lengthwise along the building wall 140, the movable scaffold support 10 may also move on top of the building roof 138 No major adjustments or changes need to be made to the scaffold 144 or the movable scaffold support 10 to accomplish this movement. The movable scaffold support 10 merely rolls along the roof 138 thereby moving the scaffold 144 with it.

Once work is completed on a building wall 140 and work needs to be done on an intersecting building wall 142, the movable scaffold support 10 can maneuver over the corner of the roof 138 so as to position the scaffold 144 in a generally parallel and spaced-apart fashion from the intersecting building wall 142. During the movement, the scaffold support 10 will always have at least three wheels 116, 118 on the supporting roof 138. See FIG. 1.

Once the work is completed, the scaffold 144 may be disconnected from the movable scaffold support 10. The movable scaffold support 10 may then be dismantled into its basic components of the front 12 and rear 70 vertical frame members, the three axles 110 and the three pairs of wheels 116, 118. The movable scaffold support 10 and its component parts may then be loaded upon a suitable carrier and carried to the next building site.

While there have been described above the principles of this invention in connection with specific apparatus, it is to be clearly understood that this description is made only by way of example and not as a limitation to the scope of the invention.

What is claimed is:

1. A movable roof supported scaffold support comprising a front vertical frame member, a rear vertical frame member, said front and rear vertical frame members being detachably connected by the opposite ends of three spaced apart rods, a pair of wheels being mounted on each of said rods, one wheel of each pair being adjacent to said front frame member, the other wheel of each pair being remote therefrom, and a scaffold connector assembly being secured to said front vertical frame member.

2. The invention of claim 1 wherein said front vertical frame member includes a front vertical post having top and bottom ends, a pair of oppositely disposed front braces being connected to said vertical post, each of said front braces including an angularly disposed member having opposite ends and a horizontal member having opposite ends, said angularly disposed member and horizontal member being connected at one of said ends thereof, other ends of said angularly disposed and horizontal members being connected to said top and bottom vertical post ends, respectively, said rear vertical frame member includes a rear vertical post having top and bottom ends, a pair of oppositely disposed rear braces being connected to said vertical post, each of said braces includes an angularly disposed member having opposite ends and a pair of horizontally disposed members having opposite ends, said angularly disposed member and said pair of horizontal members being connected at one ends thereof, the other ends of said angularly disposed and said pair of members being connected to said top and bottom rear vertical post ends, respectively, whereby said pair of horizontally disposed members function as counter weights and a ballast support.

3. The invention of claim 2 further including ballast supported on said horizontal members of said rear vertical frame member, whereby a multi-story scaffold can be supported by said support.

4. The invention of claim 1 wherein each of said wheels adjacent said front vertical frame member is mounted on a front wheel sleeve, said front wheel sleeve extending from both side of said wheel, said front wheel sleeve extends the greatest amount toward said rear vertical frame members, each of said remote wheels being mounted on a rear wheel sleeve, said front and rear wheel sleeves being journalled on said rods.

5. The invention of claim 1 wherein said scaffold connector assembly includes a pair of scaffold connectors, one of said pair of scaffold connectors being attached to each of said front vertical frame member braces, each of said scaffold connectors including a pair of arms adapted to be connected to a detachably connected scaffold.

6. The invention of claim 5 wherein said pair of scaffold connectors are connected to the exterior of said horizontal rods, respectively, each of said arms of said scaffold connectors being journaled on said exterior horizontal rods, respectively, adjacent one end thereof, and having means adjacent the other end thereof for securely fastening said arms to said scaffold.

7. The invention of claim 1 wherein said one wheels of each of said pairs includes means for restraining the bending moment in said rods.

8. The invention of claim 1 wherein said front and rear vertical frame members each include an isosceles triangular frame having a base member, an altitudinal member, and opposite congruent side members, said frame members having connectors at each position where said opposite side members and said altitudinal member are joined to said base member, said rods being joined to said frame members by said connectors.

9. The invention of claim 8 wherein said congruent side members and said base members and said altitudinal members and said connectors of said front and rear vertical frame members and said rods on which said wheels are mounted are each lengths of standard pipe.

* * * * *